US005752859A

United States Patent [19]

Abe et al.

[11] Patent Number: 5,752,859

[45] Date of Patent: May 19, 1998

[54] TERMINAL RETAINING STRUCTURE FOR CONNECTOR

[75] Inventors: Kimihiro Abe; Toshiaki Okabe, both of Shizuoka, Japan

[73] Assignee: Yazaki Corporation, Tokyo, Japan

[21] Appl. No.: 667,472

[22] Filed: Jun. 21, 1996

[30] Foreign Application Priority Data

Jun. 23, 1995 [JP] Japan ..... 7-157660

[51] Int. Cl.[6] ..... H01R 13/514

[52] U.S. Cl. ..... 439/752; 439/595

[58] Field of Search ..... 439/595, 752, 439/733

[56] References Cited

U.S. PATENT DOCUMENTS 5,588,835 12/1996 Nankoh ..... 439/509 X
5,618,207 4/1997 Maejima ..... 439/752 X

FOREIGN PATENT DOCUMENTS 5-226025 9/1993 Japan ..... H01R 13/42
6-151002 5/1994 Japan ..... H01R 13/42

*Primary Examiner*—Khiem Nguyen
*Attorney, Agent, or Firm*—Sughrue, Mion, Zinn, Macpeak & Seas, PLLC

[57] ABSTRACT

A terminal retaining structure for a doubly retainable electrical connector comprises a terminal retaining member 3 having overhang wall portions 6*a*, 6*b* and terminal retaining projecting plates 7*a*, 7*b* projecting forward from the overhang wall portions 6*a*, 6*b* for contacting projecting pieces 32 of a terminal 23; and a connector housing 1 having a bottom wall 17 with an opening 13 for inserting terminal retaining member 3 in bottom wall 13 and a flexible retaining lance 20, for retaining terminal 23, having a pair of contact stepped portions 27 formed on opposite side portions corresponding to the pair of terminal retaining projecting plates 7*a*, 7*b* for contacting the projecting pieces of terminal 23. When terminal 23 is inserted in connector housing 1 and terminal retaining member 3 is inserted in bottom wall 13, the pair of contact stepped portions 27 contact projecting pieces 32 of terminal 23, and the pair of terminal retaining projecting plates 7*a*, 7*b* simultaneously contact projecting pieces 32 of terminal 23 and the pair of contact stepped portions 27, thus preventing deformation of the flexible retaining lance 20 and separation of terminal 23 from connector housing 1.

5 Claims, 3 Drawing Sheets

TERMINAL RETAINING STRUCTURE FOR CONNECTOR

BACKGROUND OF THE INVENTION

1. Field of the Invention

The invention relates to a terminal retaining structure for an electrical connector, and more particularly to a doubly retainable connector that causes a terminal to be secondarily retained by inserting a rear holder from an opening on the bottom wall side of a connector housing, and at the same time prevents deformation of a flexible retaining lance for primarily retaining the terminal.

2. Description of the Related Art

FIGS. 5–7 show a terminal retaining structure for a doubly retainable connector disclosed in Unexamined Japanese Patent Publication No. Hei. 5-226025.

This structure provides a rear holder 43 having a terminal retaining projecting portion 46 to retain a rear stepped portion 47*a* of a terminal 47. The rear holder 43 is integrally formed with a connector housing 41 of synthetic resin through hinge bands 42 that are arranged in the rear half of the connector housing 41. The terminal retaining projecting portion 46 is also formed integrally with an overhang wall portion 45 that overhangs a main plate portion 44 of the rear holder 43.

As shown in FIG. 7, temporary retaining projections 50 are located on the lower side surfaces of the overhang wall portion 45. The temporary retaining projections 50 correspond to both side edge portions of an opening 49 continuous from a terminal accommodating chamber 48 of the connector housing 41. Claw-like projecting walls 51 are formed on both side edge portions of the opening 49. The temporary retaining projections 50 are engageable with the projecting walls 51 by passing them over the projecting walls 51 as shown in FIG. 6.

With the rear holder 42 temporarily retained as shown in FIG. 6, the terminal 47 is inserted into the connector housing 41 and primarily retained by a flexible retaining lance 52 that projects from the terminal accommodating chamber bottom wall 53 in the longitudinal direction of the accommodating chamber. Then, by pushing the rear holder 43 into the connector housing 41, the terminal retaining projecting portion 46 comes in contact with the rear stepped portion 47*a* of the terminal 47, so that the terminal 47 is secondarily retained. As a result, the terminal 47 is doubly retained, which reliably prevents the terminal 47 from separating from the housing 41.

However, the aforementioned conventional structure requires that projecting walls 51 for engaging the temporary projections 50 of the rear holder 43 be provided, and this creates the problem of increasing the width of the connector housing 41. In addition, when a strong pulling force is applied to the terminal 47, the flexible retaining lance 52 formed on the accommodating chamber bottom wall 53 is deformed upwardly, which reduces the retaining force.

SUMMARY OF THE INVENTION

The invention has been made in view of the aforementioned problems. The object of the invention is therefore to provide a terminal retairing structure for a connector whose connector housing is not increased in width as a result of the rear holder temporary retaining mechanism and whose flexible retaining lance is prevented from being deformed within the connector housing so the terminal does not become separated from the connector housing.

To achieve the above object, the invention provides a terminal retaining structure for a connector comprising a flexible retaining lance for retaining a terminal and an opening for inserting a terminal retaining member in a bottom wall of a connector housing, and a terminal retaining projecting portion of the terminal retaining member for retaining projecting pieces of the terminal by contacting those projecting pieces. The opening is located in the rear of the flexible retaining lance, and the terminal retaining projecting portion projects forward from an overhang wall portion of the terminal retaining member.

The terminal retaining projecting portion comprises a pair of terminal retaining projecting plates; a pair of contact stepped portions corresponding to the pair of terminal retaining projecting plates is formed on both side portions of the flexible retaining lance; and the pair of terminal retaining projecting plates contacts the projecting pieces of the terminal and the pair of contact stepped portions simultaneously.

The overhang wall portion of the terminal retaining member comprises a pair of overhang wall plates, the distance between the overhang wall plates being narrower than the distance between the pair of terminal retaining projecting plates. The terminal retaining projecting plates are formed in front end portions of the overhang wall plates. The overhang wall plates have temporary retaining projections, and projecting walls engageable with the temporary projections are formed on side edge portions of the opening corresponding to the overhang wall plates. A narrow wall extending longitudinally through the opening is disposed on the bottom wall of the connector housing, and a groove portion between the pair of overhang wall plates is engageable with the narrow wall.

The pair of overhang wall plates of the terminal retaining member are guided into the opening of the connector housing along the narrow wall. The temporary retaining projections engage the projecting walls of the opening, so that the terminal retaining member is temporarily retained. When the terminal retaining member is pushed further into the connector housing, the temporary retaining arrangement is released, which allows the pair of terminal retaining projecting plates to come in contact with the projecting pieces of the terminal and the contact stepped portions of the flexible retaining lance at the same time. As a result, separation of the terminal from the connector housing, as well as deformation of the retaining lance, can be prevented.

DETAILED DESCRIPTION OF THE PREFERFED EMBODIMENT

Figure 1:
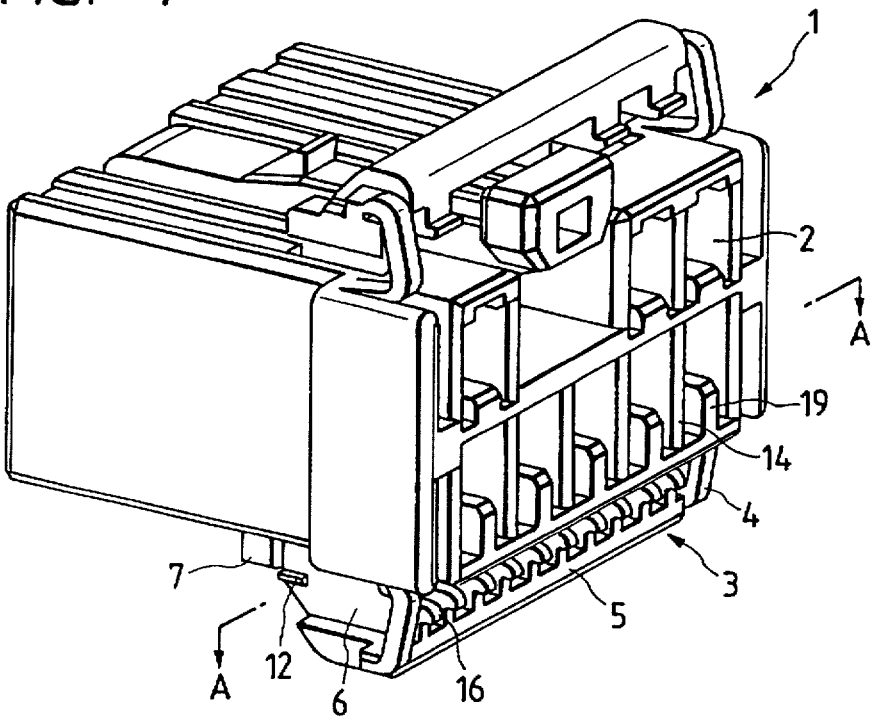
FIG. 1 is a perspective view showing a connector housing having a terminal retaining structure according to an embodiment of the invention.
Figure 2:
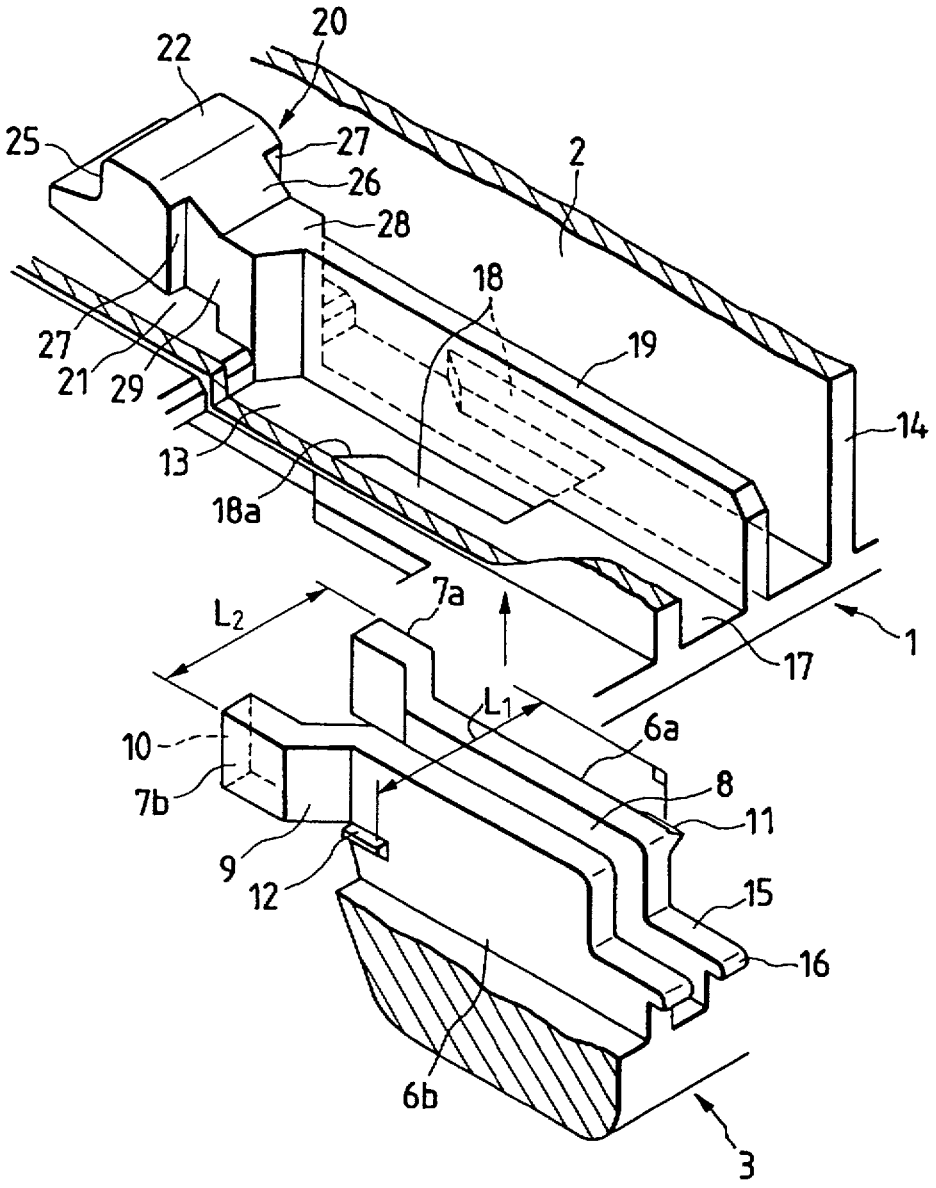
FIG. 2 is a sectional view of a terminal retaining structure of the connector taken along a line A—A of FIG. 1.
Figure 5:
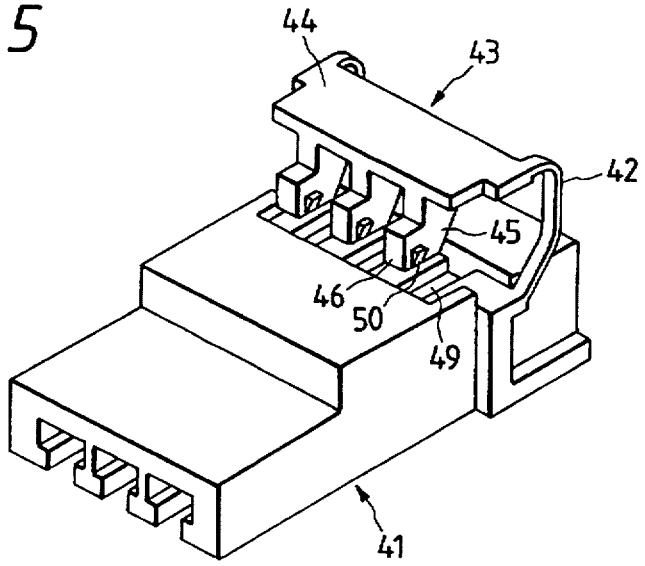
PRIOR ART FIG. 5
FIG. 5 is a perspective view showing a conventional connector.
Figure 6:
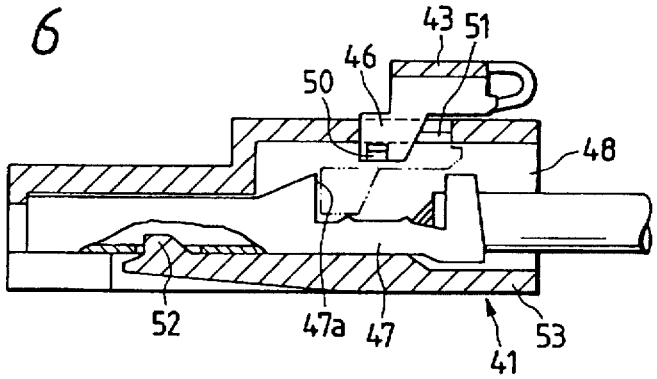
PRIOR ART FIG. 6
FIG. 6 is a longitudinal sectional view of a conventional connector housing showing the terminal retaining structure.
Figure 7:
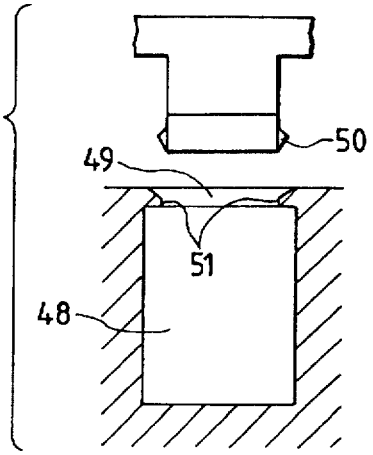
PRIOR ART FIG. 7
FIG. 7 is a transverse sectional view of a conventional connector housing showing its temporary retaining provisions.

FIGS. 1 and 2 show a terminal retaining structure for a connector according to a preferred embodiment of the invention.

As shown in FIG. 1, this structure comprises terminal accommodating chambers 2 arranged in two levels in a connector housing 1, and a rear holder (terminal retaining member) 3 insertable into the lower level of the terminal accommodating chambers 2. The connector housing 1 is made of synthetic resin. The rear holder 3 is integrally formed with the connector housing 1 through hinge bands 4 on the bottom wall side of the connector housing 1. The rear holder 3 has a plurality of overhang wall portions 6 which overhang in comb-like form from a horizontally extending main plate portion 5. The main plate portion 5 serves as an operating portion. A terminal retaining projection 7 is integrally formed at the front end of each overhang wall portion 6.

As shown in FIG. 2, which is a sectional view taken along a line A—A of FIG. 1, a longitudinally extending groove 8 is formed in the middle of the overhang wall portion 6, and a pair of rather thin overhang wall plates 6*a*, 6*b* extend parallel to each other with the groove 8 therebetween. The terminal retaining projection 7 has a pair of terminal retaining projecting plates 7*a*, 7*b*. The terminal retaining projecting plates 7*a*, 7*b* project forward through tapered wall portions (constricted portions) 9 from the front ends of the corresponding overhang wall plates 6*a*, 6*b*, respectively. The distance between the pair of overhang wall plates 6*a*, 6*b* is narrower than the distance between the pair of terminal retaining projecting plates 7*a*, 7*b*. The pair of terminal retaining projecting plates 7*a*, 7*b* have vertical retaining surfaces 10 at the front ends thereof, respectively.

A first temporary retaining projection 11 is formed at a rear end portion of the outer side surface of the overhang wall portion 6*a*, whereas a second temporary retaining projection 12 is formed at a front end portion of the outer side surface of the other overhang wall portion 6*b*. The first temporary retaining projection 11 is located at an upper end portion of the overhang wall portion 6*a*, whereas the second temporary retaining projection 12 is located in the middle of the overhang wall portion 6*b*. The distance between the temporary retaining projections 11, 12 in the height direction is equal to or slightly larger than the thickness of a side edge portion of an opening 13 that allows the rear holder 3 to be inserted into the connector housing 1.

Further, the distance (outside width) $L_1$ between the temporary retaining projections 11, 12 in the width direction is narrower than the distance (outside width) $L_2$ between the pair of terminal retaining projecting plates 7*a*, 7*b*. That is, the temporary retaining projections 11, 12 are inboard of the outer side surfaces of the terminal retaining projecting plates 7*a*, 7*b*, respectively. As a result of this arrangement, the temporary retaining projections 11, 12 can be designed to engage the side edge portions of the opening 13, which will be described later, without expanding the width of the terminal accommodating chamber 2; i.e., without increasing the distance between partition walls 14 of the terminal accommodating chamber 2. The width of the terminal accommodating chamber 2 is almost equal to the width of a terminal to be inserted thereinto. Each of the temporary terminal retaining projections 11, 12 is triangular in longitudinal cross section and has outwardly tapering upper and lower slopes. A cutaway stepped portion 15 is formed at the rear of each of the overhang wall plates 6*a*, 6*b*, and a regular retaining projection 16 is formed at the rear of the stepped portion 15 so as to project from the stepped portion 15.

The opening 13 that communicates with the terminal accommodating chamber 2 is formed in a bottom wall 17 of the connector housing 1. The overhang wall portion 6 of the rear holder 3 can be inserted through the opening 13. A pair of flange-like projecting walls 18 engageable with the temporary retaining projections 11, 12 are formed on both sides of the opening 13 and project inward toward the opening 13. A tapered portion 18*a* that mates with the constricted portion 9 is formed at the front end of each projecting wall 18. The length of the straight portion of the projecting wall 18 is almost equal to the length between the front end and the rear end of the overhang wall portion 6.

A narrow wall portion 19 in the middle of the opening 13 extends in a longitudinal direction (along the length of the terminal accommodating chambers 2). A flexible retaining lance 20 is formed at the front of the narrow wall 19. The narrow wall 19 extends along the length of the bottom wall 17 from the rear opening of the terminal accommodating chamber 2 to the front end of the opening 13, and divides it in half.

The width of the narrow wall 19 is slightly less than the inside width of the groove portion 8 of the overhang wall portion 6. The height of the narrow wall 19 inside the opening 13 is almost equal to or smaller than the depth of the groove 8. The pair of overhang wall plates 6*a*, 6*b* enter the opening 13 smoothly, guided by the narrow wall 19 while allowing the groove 8 thereof to engage the narrow wall 19. The pair of overhang wall plates 6*a*, 6*b* are positioned by the narrow wall 19, and as a result, the terminal retaining projecting plates 7*a*, 7*b* are reliably positioned. The flexible retaining lance 20 projects slightly obliquely upward from the bottom wall 17, and extends forward from the front end of the opening 13. A space 21 for allowing the lance to flex is interposed between the retaining lance 20 and the bottom wall 17.

The retaining lance 20 has a retaining projection 22 on its top, a retaining stepped portion 25 in front of the retaining projection 22, and a slidable tapered surface 26 in the rear of the retaining projection 22. The retaining stepped portion 25 has a surface that comes in contact with an engagement hole 24 of a terminal 23 (see FIG. 3). The tapered surface 26 is designed to press the retaining lance 20 downward while coming in slidable contact with the terminal 23 at the time of inserting the terminal 23. The arrangement described thus far is the same as in the conventional example.

A pair of contact stepped portions 27 are formed on both sides of the retaining projection 22 and extend vertically from the middle of the height of the tapered surface 26. The pair of contact stepped portions 27 have vertical contact surfaces that face rearward to confront the front-end retaining surfaces 10 of the terminal retaining projecting plates 7*a*, 7*b* of the rear holder 2. The thickness of a thin-walled portion 28 of the retaining lance 20 between the pair of contact stepped portions 27 is slightly smaller than the inside width of the pair of terminal retaining projecting plates 7*a*, 7*b*. Thus, the inner surfaces of the terminal retaining projecting plates 7*a*, 7*b* come in slidable contact with the side surfaces 29 of the contact stepped portions 27.

Figure 3:
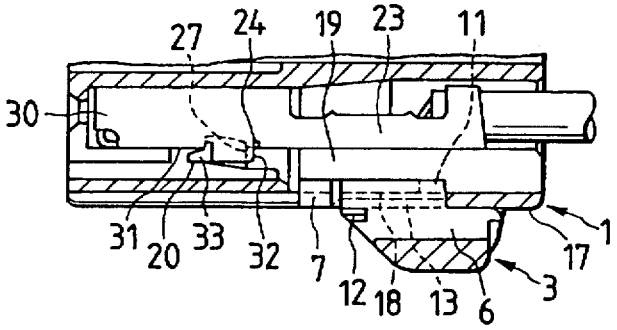
FIG. 3 is a longitudinal sectional view of the connector with a rear holder temporarily retained.

FIG. 3 shows the rear holder 3 temporarily retained by the connector housing 1. That is, the first temporary retaining projection 11 is passed over the corresponding projecting wall 18 of the opening 13 so that the projecting wall 18 is interposed between the first temporary retaining projection 11 and the second temporary retaining projection 12, which in turn allows the rear holder 3 to be temporarily retained in the connector housing 1. The terminal 23 is then inserted into a corresponding terminal accommodating chamber 2. Since the overhang wall portions 6 of the rear holder 3 are retained by the opening 13, play in the rear holder 3 in the temporarily retained condition is prevented, which allows the terminal 23 to be inserted into the corresponding terminal accommodating chamber without interfering with the rear holder 3.

The terminal retaining projecting plates 7*a*, 7*b* of the rear holder 3 are positioned within the opening 13 in the temporarily retained condition shown in FIG. 3. Furthermore, the cutaway stepped portions 15 in the rear of the rear holder are in contact with the bottom wall 17. Still further, the terminal 23 is slid along the upper end surface of the narrow wall 19 within the accommodating chamber 2, which allows the retaining projection 22 of the retaining lance 20 to enter the engagement hole 24 of a bottom plate portion 31 of a box-like electric contact portion 30 of the terminal 23. The rear end of a stabilizer (a pair of projecting pieces 32 designed to prevent inverted insertion of the terminal 23 and to enable smooth insertion of the terminal) substantially coincides with the contact surfaces of the contact stepped portions 27 of the retaining lance 20 and extends forward to contact side surfaces 33 of the retaining lance 20.

Figure 4:
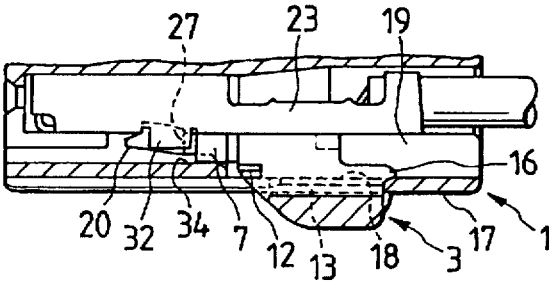
FIG. 4 is a longitudinal sectional view of the connector with the rear holder regularly retained.

FIG. 4 shows the rear holder 3 retained by the connector housing 1 after being pushed obliquely upward and forward. That is, the second temporary retaining projection 12 is positioned within the opening 13 while moving away from the corresponding projecting wall 18, which in turn causes the regular retaining projections 16 to pass over the bottom wall 17 of the connector housing 1 to engage the rear end of the opening 13. The pair of overhang wall plates 6*a*, 6*b* advance toward the lower portion of the terminal 23 while staying astride the narrow wall 19. The narrow wall 19 prevents transverse displacement of the rear holder 3. The upper end surfaces of the overhang wall plates 6*a*, 6*b* become coplanar with the upper end surface of the narrow wall 19, so that the terminal 23 is stably supported.

In addition, the pair of terminal retaining projecting plates 7*a*, 7*b* project forward along an inner housing wall 34 that is in front of the opening 13, so that the pair of terminal retaining projecting plates 7*a*, 7*b* come in contact with the rear end surfaces of the pair of projecting pieces 32 on both left and right sides of the terminal 23, respectively, and with the contact stepped portions 27 on both sides of the retaining lance 20. Therefore, deformation of the retaining lance 20 (deformation upwards, or to the left or the right) is blocked. That is, the retaining surfaces 10 on the front ends of the pair of terminal retaining projectLng plates 7*a*, 7*b* come in contact with the projecting pieces 32 of the terminal 23 which in turn contact the contact stepped portions 27 of the retaining lance 20, which prevents disengagement of the terminal 23 from the connector housing 1 (double retainment) and deformation of the retaining lance 20 simultaneously. Hence, terminal retaining force is increased.

As described above, the invention enables the terminal retaining member 3 to simultaneously prevent deformation of the flexible retaining lance 20 for primary retainment of the terminal 23, and prevent the separation of a terminal 23 from the connector housing 1 (secondary retainmnent of the terminal). Therefore, not only is terminal retaining force increased, but unwanted separation of the terminal due to the application of a strong pulling force is reliably prevented. Since the pair of overhang wall plates 6*a*, 6*b* is guided along the narrow wall 19 within the opening 13, the pair of terminal retaining projecting plates 7*a*, 7*b* are positioned with respect to the projecting pieces 32 of the terminal 23 to improve terminal retaining capability. Furthermore, since the distance between the temporary retaining projections 11,12 on the overhang wall plates 6*a*, 6*b* is less than the distance between the terminal retaining projecting plates 7*a*, 7*b*, the distance between the projecting walls 18 of the opening 13 car be narrower than the width of the terminal accommodating chamber 2, which eliminates the need for increasing the width of the connector housing 1. This allows the connector to be downsized and allows a multi-pole connector design to be implemented.

What is claimed:

1. A terminal retaining structure for a connector, comprising:

a terminal retaining member having an overhang wall portion and a terminal retaining projecting portion projecting forward from said overhang wall portion, said terminal retaining projecting portion comprising a pair of terminal retaining projecting plates for contacting projecting pieces of a terminal;

a connector housing having a bottom wall, a flexible retaining lance for retaining said terminal, said flexible retaining lance comprising a pair of contact stepped portions formed on opposite side portions corresponding to said pair of terminal retaining projecting plates; and an opening in said bottom wall, disposed at the rear of said flexible retaining lance, for inserting said terminal retaining member in said bottom wall;

wherein when said terminal is inserted in said connector housing and said terminal retaining member is inserted in said bottom wall, said pair of contact stepped portions contact said projecting pieces of said terminal, and said pair of terminal retaining projecting plates simultaneously contact said projecting pieces of said terminal and said pair of contact stepped portions.

2. A terminal retaining structure for a connector according to claim 1, wherein said overhang wall portion of said terminal retaining member comprises a pair of overhang wall plates, the distance between said overhang wall plates being narrower than the distance between said pair of terminal retaining projecting plates.

3. A terminal retaining structure for a connector according to claim 2, wherein said terminal retaining projecting plates are disposed in front end portions of said overhang wall plates.

4. A terminal retaining structure for a connector according to claim 2, wherein said overhang wall plates have temporary retaining projections for temporarily retaining said terminal retaining member in said connector housing, and wherein said opening has projecting walls engageable with said temporary retaining projections, said projecting walls being disposed on side edge portions of said opening corresponding to said overhang wall plates.

5. A terminal retaining structure for a connector according to claim 2, wherein a narrow wall extending longitudinally through said opening is disposed on said bottom wall of said connector housing, and said pair of overhang wall plates have a groove portion between them engageable with said narrow wall.

* * * * *